US006410862B1

(12) United States Patent
Lecann

(10) Patent No.: US 6,410,862 B1
(45) Date of Patent: Jun. 25, 2002

(54) DEVICE AND METHOD FOR MEASURING THE FLOW RATE OF DRILL CUTTINGS

(75) Inventor: Jean-Paul Lecann, Dammartin en Goële (FR)

(73) Assignee: Geoservices S.A., Le-Blanc-Mesnil Cedex (FR)

( * ) Notice: Subject to any disclaimer, the term of this patent is extended or adjusted under 35 U.S.C. 154(b) by 0 days.

(21) Appl. No.: 09/462,311

(22) PCT Filed: May 7, 1999

(86) PCT No.: PCT/FR99/01090

§ 371 (c)(1),
(2), (4) Date: Jan. 6, 2000

(87) PCT Pub. No.: WO99/57415

PCT Pub. Date: Nov. 11, 1999

(30) Foreign Application Priority Data

May 7, 1998 (FR) ..... 98 05822

(51) Int. Cl.[7] ..... G01G 19/40; E21B 21/08; E21B 44/00

(52) U.S. Cl. ..... 177/17; 177/18; 177/245; 73/152.21; 73/152.43

(58) Field of Search ..... 177/116, 145, 177/17, 18, 22, 23, 24, 50, 59, 154; 73/152.21, 152.4, 152.43, 861.71, 861.73, 861.74; 222/36, 37, 55, 77

(56) References Cited

U.S. PATENT DOCUMENTS 3,254,729 A * 6/1966 Behlen ..... 177/116
3,602,322 A * 8/1971 Gorsuch ..... 73/152.21
4,840,061 A * 6/1989 Peltier ..... 73/152.21
5,563,384 A * 10/1996 Marlow et al. ..... 177/50

OTHER PUBLICATIONS

WO 93/05366 Mar. 1993.

* cited by examiner

*Primary Examiner*—Randy W. Gibson
(74) *Attorney, Agent, or Firm*—Pearne & Gordon LLP

(57) ABSTRACT

This invention relates to a device for measuring the flow rate of spoil from a drilling brought to the surface by means of a drilling fluid. The device comprises means of collecting the spoil and means of continuously measuring the weight of spoil collected.

The means of collecting the spoil comprise a receptacle in the shape of bucket articulated about a spindle and means of tilting the receptacle in such a way that the bucket is emptied. The measurement means comprise a measuring cell connected to the tilting means in order to measure a stress proportional to the weight of the spoil collected. The invention also relates to a method for the application of a measurement of the spoil flow rate from a drilling.

10 Claims, 4 Drawing Sheets

DEVICE AND METHOD FOR MEASURING THE FLOW RATE OF DRILL CUTTINGS

This invention relates to a device and a method for carrying out measurements on drilling debris or "cuttings", in particular continuously to measure, using the weighing principle, the flow rate of debris brought from the bottom of a bore drilled using a bit driven in rotation and with the help of a cleaning fluid.

Until now, within the expertise of a mud logger or a supplier of monitoring services for information revealed by means of the circulation fluid used during drilling, the data relating to the spoil are restricted to an imprecise observation at a point in time of the pieces of rock brought to the surface which are collected by the site geologist at regular intervals at the outlet from a vibrating screen. It is therefore impossible to examine trends relating to the flow rate of the spoil: the flow rate can diminish if the cleaning of the bore is not sufficient, the flow rate can increase if the walls of the bore collapse or if the diameter of the drilling is increased.

The purpose of this invention relates to a system capable of informing us, at the surface, about the instantaneous mass and/or volume flow rate of rocks drilled by a drilling bit.

Document U.S. Pat. No. 4,413,511 is known which describes a system of continuous measurement of the volume of drilling spoil and the quantity of drilling fluid transported with this spoil. This system does not have the same objective as this present invention and is structurally different, notably with regard to the measurement means which use tubs filled with a fluid, the variation in the level of which is continuously measured.

Hence, this invention relates to a device for measuring the flow rate of spoil from a drilling brought to the surface by means of a drilling fluid. The device comprises means for collecting the spoil and means of continuously measuring the weight of spoil collected. In the invention, the means of collecting the spoil comprise a receptacle in the shape of bucket, pivoting about one axis and means of tilting the receptacle in such a way that the bucket is emptied and the measurement means comprise a measuring cell connected to the tilting means in order to measure a stress substantially proportional to the weight of the spoil collected.

The tilting means can comprise a shaft rotating on two bearings, a pneumatic jack connected to said shaft, and a component connecting said jack to a fixed base.

Said measuring cell can be arranged on said connecting component.

The cell can measure a bending stress of the connecting component, said stress being substantially proportional to the weight of the spoil collected.

The tilting means can comprise pneumatic components with command logic for the sequence of operations for said tilting means.

The invention also relates to a method of measuring the flow rate of drilling spoil brought to the surface by a drilling fluid wherein the following steps are carried out:

a) the spoil is collected continuously in a receptacle for a defined period of time,
b) said accumulated spoil is continuously weighed during said period,
c) said receptacle is emptied at the end of said period,
d) operations a) and b) are repeated
e) the spoil weights are accumulated by means for processing the measurement
f) calculation of the spoil flow rate is carried out
g) the spoil flow rate measurement is processed in order to calculate and/or to record at least one of the following parameters: the flow rate of the spoil as a function of time, the ratio of the flow rate of the spoil to the rate of penetration, the ratio of the measured flow rate of the spoil to the theoretical flow rate of the drilled spoil, the difference between the measured flow rate of the spoil and the theoretical flow rate of the drilled spoil.

In the measurement method, the parameters can be expressed as a function of the mass flow rate.

In a variant, one can measure the density of the spoil collected.

In the preceding variant, the density of the dry spoil can be measured, that is to say, after removal of the drilling fluid.

The parameters can be expressed as a volume flow rate by using at least one of the measurements of the density: before or after removal of the drilling fluid.

With the purpose of making use of the measurement of the spoil flow rate, this device has been developed from research into two main applications:

a) To be able to display
   a provisional image of the profile of the bore
   the trend to either exceed or to fall short of the theoretical drilled volume.
b) To be able to correlate this image with the real context of the drilling operations under way, in order to know the influence of certain drilling actions on the behavior of the measurement of the mass or volume flow rate of the spoil.

Through this new measurement of volume or mass flow rate of the spoil, an observation of the historical returns is available put back into its drilling context (behavior and measurement trends, reproducibility of the observed phenomena).

The driller is thereby given the means to optimize the cleaning of the bore or to diagnose instability of the walls.

This invention will be better understood and its advantages will become more clearly apparent on reading the following embodiment examples, which are in no way limitative and are illustrated by the appended figures among which:

FIG. 1 describes the general principle of monitoring during drilling

FIG. 2A describes a view from above of an embodiment of the device according to the invention.

Figure 1:
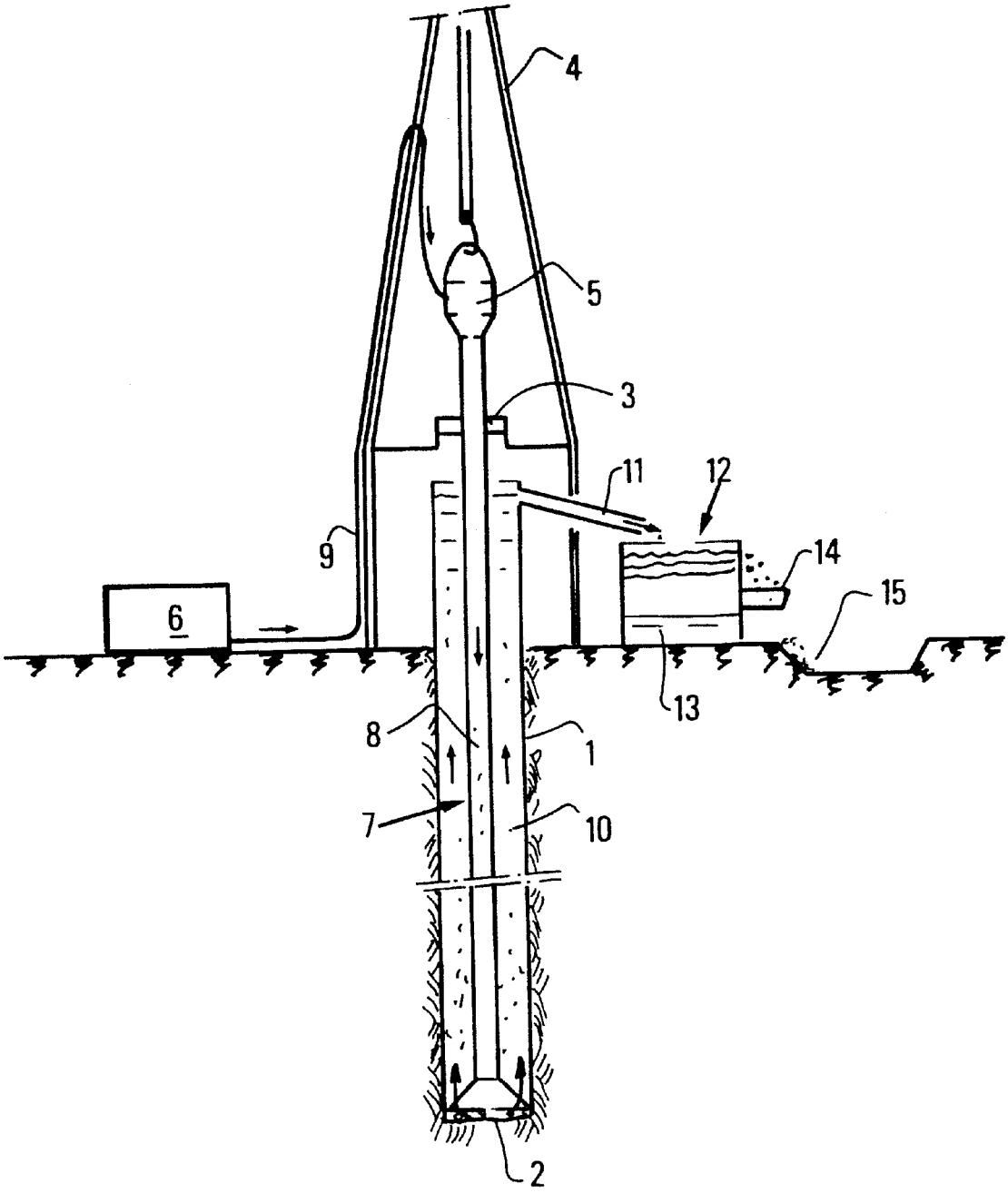

FIG. 1 shows a bore 1 drilled with the help of a drilling bit 2 driven in rotation by a surface installation 3 (rotary table). A conventional drilling tower 4 controls the weight on the bit 2 thanks to lifting means to which an injection head 5 is connected. This injection head 5 is screwed onto the upper part of the drill string 7 made up of an assembly of drill tubes or drill rods.

The drilling installation includes a pumping installation 6 which drives a fluid called a drilling fluid back into the internal space 8 of the drill string using a pump, a pipe 9 and an injection head 5.

The drilling fluid descends to the bottom of the bore to gush out of the drill string at the level of the drilling bit fitted with jets intended to clean out the rock debris both from the drill bit and from the cutting face.

As the fluid returns to the surface within the annular space 10 defined by the bore 1 and the outside of the tubes 7, it also carries the drilling spoil with it towards the surface.

At the surface, under the drill floor, a conduit 11 directs the drilling fluid and the entrained debris onto a vibrating screen 12. A vibrating screen comprises one or two screens made up of meshes which are more or less large depending on the size of the debris. The screens are agitated in a vibratory movement to carry out a mechanical separation of the debris and the drilling fluid. The fluid falls into a trough 13 to be recycled directly or after a further treatment of separation of finer particles. The debris slides over the screen to fall into the device 14 according to the invention where the mass flow rate is measured.

Next, the weighed debris is discharged by means of this device into a waste trench 15.

Figure 2A:
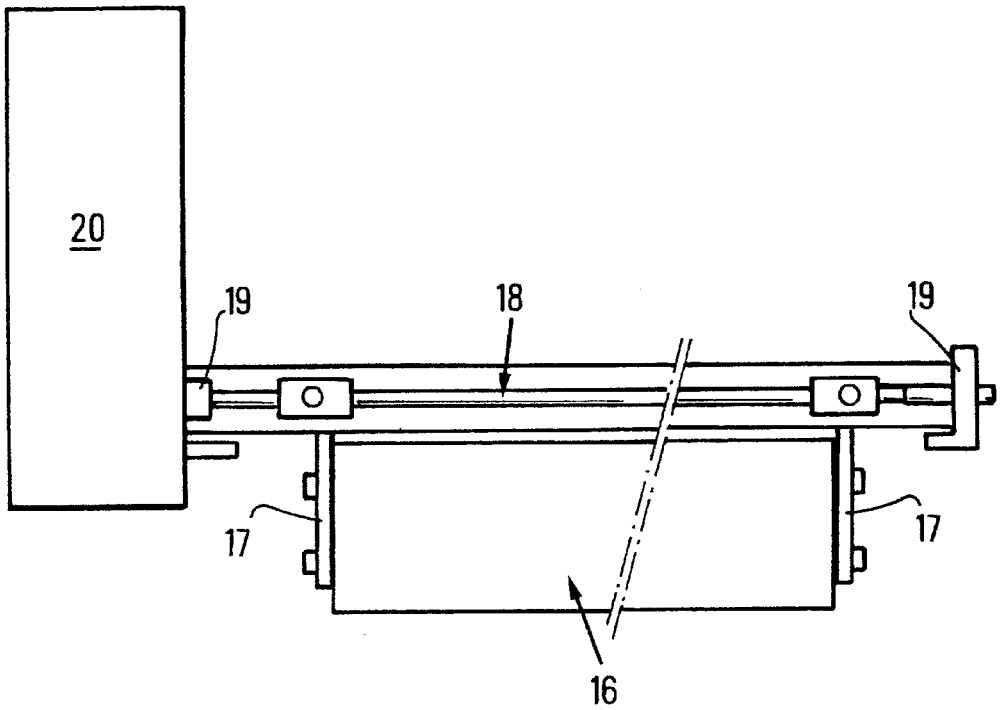
FIG. 2B shows a view from the side of the device

FIG. 2A describes an embodiment of the device according to the invention. It represents a view from above of the means for collecting the debris and the means of weighing said debris. Reference number 16 designates a receptacle in the shape of a bucket intended to be positioned under the off-take from the vibrating screen (reference number 12, FIG. 1). The width of the bucket 16 is at least equal to the width of the vibrating screen so as to collect all of the spoil which is retained by the screen.

On either side of the bucket, arms link the bucket to a shaft 18 attached through at least two bearings 19. The bucket is thereby linked in rotation with the shaft 18. Hence, rotation of said shaft 18 causes the bucket to tilt between at least one position where it receives spoil and a position for emptying the spoil. The presence of the two bearings 19 and the shaft 18 rigidly fixed to the bucket 16 allows one to provide great rigidity of the assembly and enables it to resist impact, vibration and overload commonly met with in the area surrounding the vibrating screens.

At one end of the shaft, an extension extends into a casing 20 sealed against external fluids. This casing contains the various means for carrying out the rotation of at least a quarter turn of the shaft 18 and the means of weighing the materials collected by the bucket 16. Here the means used to fix and to arrange the device close to the vibrating screen will not be described since they are within the comprehension of a man skilled in the art of general mechanical engineering.

Figure 2B:
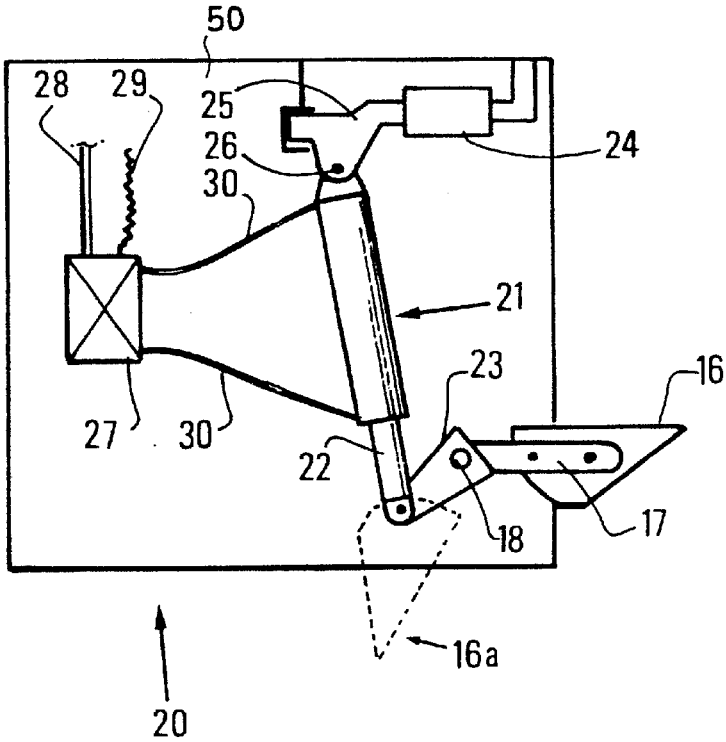

FIG. 2B describes more precisely a particular embodiment for the means of mechanizing and tilting said bucket.

This figure is a diagrammatic view from the side of the device according to the invention. The bucket 16 is connected in rotation with the shaft 18 by arms 17. Another arm is also connected in rotation with the shaft 18. The rod 22 of the pneumatic, hydraulic or mechanical jack 21 is attached onto the end of the arm 23.

The end 26 of the body of the jack 21 co-operates with a component 25 which has the double function of holding the jack so that it can actuate the bucket and transmit the force to a cell 24 for measuring said stress, for example of the strain gauge type. An upper and lower stop 50 enables one to prevent an overload being applied to the cell 24 by restricting the movement of the free end of this cell. These stops are adjustable in such a way that in normal operation they do not come into contact with the free end of the cell 24 but contact does occur before the cell can be damaged by an overload.

In addition, the casing 20 contains command means 27, for example a pneumatic servo valve powered by a compressed air pipe 28 and remotely commanded by a pneumatic, hydraulic or electric command line 29. In particular, a command system for the jack 21 can be designed made up of two pneumatic timers that command pneumatic valves. A timer is used to adjust the time during which the bucket 16 is raised and during which the drilling spoil is collected in it. The second timer is used to adjust the time during which the bucket is tilted in a way that permits the spoil accumulated in it to be discharged before starting a new measuring cycle. Each timer is separately adjustable which allows the cycle of the device to be adapted to the drilling and circulation conditions. Pipes 30 supply the piston side or the rod side to move the rod 22 in one direction or another. Of course, it is also possible to use a simple jack effect. In FIG. 2B, the silhouette 16A represents the position of the bucket in the position for emptying the bucket. With this device, it is only necessary to fit a single compressed air supply pipe to the command device and a single electric line for the measurement of the force that corresponds to the weight of the spoil accumulating in the bucket. In this way, bringing the system into conformity with electrical safety standards is greatly simplified. Similarly, the use, the maintenance and the reliability of the system is greatly improved.

It is clear that this invention is not limited to the embodiment described by FIG. 2B. In effect, the measurement cell 24 can be placed in another place on the tilting means, for example on the bearings 19, on the shaft 18, on the piston rod 22, or some other place.

The operation of the weight measuring device is as follows:

- At the start, the bucket is in the horizontal position (according to FIG. 2B) to collect the spoil.
- Through the mechanical action of the arms 17, the shaft 18, the lever arm 23, the jack 21 and the component 25, the force corresponding to the weight of the spoil accumulated in the bucket, is expressed by a stress proportional to said force measured by the cell 24.
- The cell 24 transmits, preferably electrically, the stress measurement to a recording and processing unit.
- The recording and processing unit records the change in the stress, that is to say the weight of the spoil, in real time as a function of time.
  - At the end of a certain time, dependent for example on the flow rate of drilling fluid returning from the bottom of the bore, it is necessary to empty the bucket. For example, the filling time can be adjusted between 0 and 16 minutes and the tilting time between 0 and 30 seconds by the pneumatic timers. The command systems send the order for the jack rod, which carries out the tilting of the bucket, to return to position 16A (FIG. 2B). The spoil is discharged into a trench or onto a belt which carries the spoil towards the disposal site. A water jet can be added which is triggered when the bucket is in the emptying position, to wash out the bucket and ensure the discharge is as complete as possible.
- In a variant, the operation can decide to operate on the basis of the weight that is acceptable in the bucket. When the weight measurement reaches a predetermined value, then the order to empty the bucket is sent.

Of course, equivalent arrangements of different mechanical means can be used without departing from the scope of this present invention.

Figure 3:
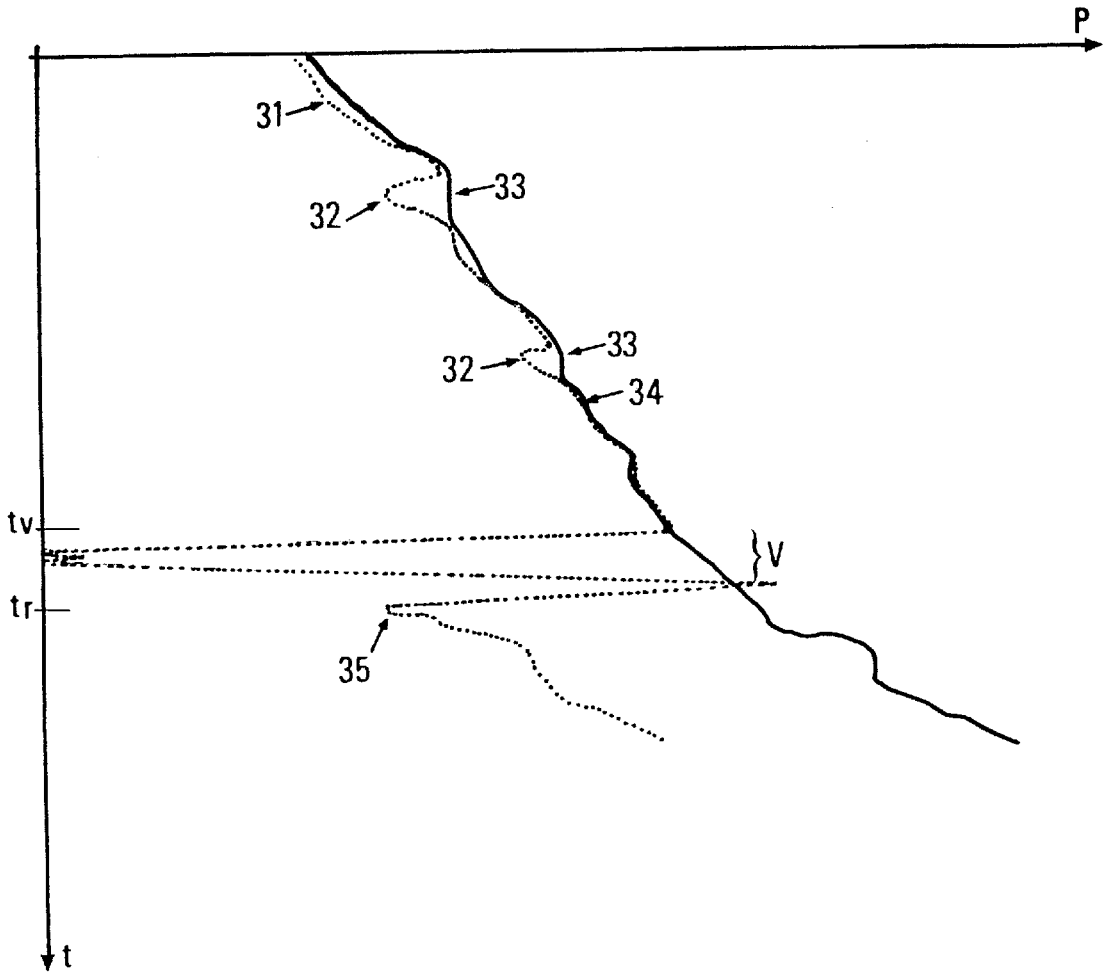
FIG. 3 shows an example of a curve recording the weight of the spoil

FIG. 3 represents an example of a record of the weights P of spoil (x-axis) as a function of time t (y-axis).

The curve 31 represents the increase in weight of the spoil in the bucket. Calibration of the measurement cell is carried out regularly with the weighing of at least two known weights. Anomalies 32 can be seen on this record caused by instability of the signal. The processing software gets rid of these anomalies as can be seen in 33.

Measurement anomalies can be of several kinds. One may mention, by way of example, the generation of measurement noise due to vibration coming from the vibrating screens or abnormal variations like a fall due to external interventions (handling by site personnel taking spoil sample). The noise can be filtered using analogic methods upstream of the data acquisition system or can be filtered with logical methods by the data acquisition software. The abnormal falls are processed at the acquisition software by fixing the signal 31 making it constant at the last datum acquired as soon as a signal reduction is detected.

At time tv, the order to tilt the bucket is sent, after a given time interval or when a value for the weight of spoil has been reached (for example, half the maximum weight which the bucket can collect).

On emptying, the weight curve 31 reduces rapidly following emptying. The parasitic peaks observed are due to the dynamics of the movements. The time interval V corresponds to the emptying time. At point 35, the bucket again takes up the horizontal position and the weight of spoil collected increases. The curve 34 accumulates the weight which is being measured with the cumulative value of the weight at the moment of the discharge phase. It will therefore be observed in FIG. 3 that the measurement 31 cannot be made use of during time interval V. However, changes in this measurement can be estimated during this interval by using variations in the signal 31 before the tilting signal has been given at time tv. By way of example, one can calculate the line of least squares over a period before the time tv and estimate the change during the time interval V in accordance with the gradient of this line of least squares. Other methods can also be envisaged, such as using the change in the signal 31 before the time tv but also using its change once the bucket has returned to its measurement position at time tr.

The emptying of the bucket during time interval V is not essential. In effect, at time tr the bucket returns to a horizontal position and the signal 31 indicates a certain value which depends, in particular, on the quantity of spoil which has been stuck in the bucket 16. The acquisition software uses this value at time tr as a new zero for the measurement and therefore only takes into account changes in this signal 31 with respect to this new zero. Hence, the resulting signal 34 exactly represents the weight of spoil that has fallen into the bucket in the course of time.

This methodology allows the quality of the measurement to be monitored. If the zero of the signal 31 at time tr has a tendency to increase with time, this means that the cleaning out of the bucket is being carried out at least less well and that it is necessary to intervene to clean it. By doing this one avoids a loss of quality as a result of the bucket 16 overflowing because, during the course of time, it is emptying out the spoil that falls into it less and less well.

From the measurement of the cumulative weight, the equivalent volume is calculated from the formula Volume= weight/density.

The measurement of the density of the mixture falling into the bucket is made by an operator in accordance with the geological sampling step defined for a drilling stage, or in the event of a change in the lithological facies. Numerous methodologies are possible to measure the density of the mixture falling into the bucket. One of the most simple and most reliable methodologies consists of filling a receptacle of known volume with the mixture and weighing the receptacle on a precision balance. It is necessary to avoid any air being entrapped in the receptacle when it is filled with the mixture which is composed of solid particles of variable sizes (the spoil) and liquid (drilling fluid). One of the most tried and tested methods is to put the receptacle on a vibrating support and to continue filling it to the required level.

The conversion requires that the density of the drilling fluid and that of the clean and dry spoil be known. Proven methods exist for measuring these two densities. For the drilling fluid one can mention the mud balance or the gamma densimeter or coriolis. For example, for clean and dry spoil, one can use the method consisting of weighing a defined volume of spoil and measuring this volume by measuring the increase in volume of a fluid suitable for having the spoil immersed in it.

Having made these three measurements, one can then convert the measurement of the spoil weight into a measurement of spoil volume by using the following formula:

$$Volume = Mass * \frac{1}{D_{mel}} * \frac{D_{mel} - D_{fl}}{D_{roc} - D_{fl}}$$

with:

$D_{mel}$; Density of the mixture $D_{fl}$; Density of the drilling fluid $D_{roc}$; Density of the cleaned and dried spoil It should be noted that the measurement of the density of the mixture is the only new measurement, the others being commonly and regularly carried out on drilling sites. However, this density measurement provides new information on the efficiency of the vibrating screens. In effect, one can also measure the flow rate of the drilling fluid falling into the bucket with the spoil. If this flow rate becomes too high, this is a sign either that the vibrating screens are not functioning correctly or that the mud has lost certain of its properties. These measurements will be used for multiple calculations for comparison or estimation of the volume flow rate (of the mixture or dry) of spoil with respect to the drilling operation underway.

Apart from the display of the control for operation of the machines for weighing the spoil, the acquisition system provides in real time, the possibility of observing several essential parameters such as a graphical representation of the depth drilled as a function of time through a digital display.

These parameters can be, for example;

1. Spoil Flow Rate as Unit Volume/Unit Time (in Liter/minute)

This is found from a calculation of the gradient of the variation in cumulative weight of spoil (or volume) per unit of time.

2. Spoil Flow Rate as Unit Volume/Length Drilled (in Liter/meter)

This is found from the accumulated group of measurements of the volume of spoil for a depth interval. This parameter can be corrected for the time spent bringing spoil from the bottom of the bore to the surface (the "lag time") by the software for processing the estimated time.

3. Ratio of the Flow Rate of the Spoil in Unit Volume/Nominal Flow Rate

This is found from a calculation of the gradient of the variation in the volume of spoil per unit of time divided by the instantaneous rate of penetration (ROP) multiplied by the theoretical cross section of the drilled bore. This parameter is drawn as a function of time.

4. Cumulative Flow Rate of Spoil in Unit Volume-Volume Drilled

This is found from the accumulated group of measurements of the volume of spoil from which the volume drilled is subtracted. This accumulation is set at zero by the operator.

Of course, it is possible to obtain similar parameters in mass flow rate instead of volume flow rate.

These different parameters allow one to know if the drilling operations are tending to:

have a short-fall in spoil returns have normal spoil returns have an excess of spoil returns Parameter 1), spoil flow rate in unit volume/unit time (in liters/minute) allows one to analyze if certain drilling actions are sufficiently efficient to clean the bore.

In effect, for certain types of bore, the spoil does not easily come up to the surface. One is then obliged regularly to undertake specific actions to clean the bore. One may mention reaming or the temporary circulation of a high viscosity drilling fluid (viscous pills). The monitoring of the volume of mass flow rate over time allows one to quantify the effectiveness of these actions and to take the decision to continue them or to take them up again.

Parameter 2), spoil flow rate in unit volume/drilled length (in liters/meter) allows one to analyze if certain drilling actions are tending to collapse the walls of the hole by hydraulic or mechanical destabilization actions. These destabilization actions can in effect break the rocks in the walls of bores by impact and vibration from the drill string. At the surface one then notes the arrival of spoil if one is redrilling or an increase in the flow rate of spoil if one is drilling. Following the changes in this parameter with depth permits the indication of regions of the bore which are particularly fragile. Hence in the course of handling operations or while drilling one can then choose drilling procedures or parameters which will prevent the destabilization of the walls of the bore.

This parameter is also of further interest: in certain cases, the walls of the bore collapse naturally causing cellars where the spoil will have a tendency to accumulate. The monitoring of this parameter can allow one to mark these areas of cellar formation, to estimate the spoil accumulating in them and to indicate events that put the spoil accumulated in the cellars back into circulation. It can then be seen that this parameter provides very valuable assistance when drilling into unstable formations.

Parameter 3) the ratio of spoil flow rate in unit volume/nominal flow rate allows one to give an instantaneous indication of the quality of the cleaning of the bore. In ideal conditions, this ratio must be equal to 1. If it becomes less than 1, this means that the spoil is accumulating in the bore and that long-term there is a risk of the drill string being jammed by the spoil. If it becomes greater than 1, this means that either spoil is being put back into circulation or that the hole is being cut down by the abrasive or chemical action of the drilling fluid or by the mechanical action of the drill string.

Parameter 4) the cumulative flow rate of spoil in unit volume-volume drilled allows one to quantify the change in the degree of clogging of the bore, that is to say the level to which the bore is being filled with spoil, which gives an assessment of the level of risk of subsequent jamming of the lining of the bore.

Apart from these parameters, the measure obtained by the device according to the invention, contains much other information, for example:

the decrease in the quantity of spoil when the rotation is stopped which could be linked to the transported quantity of drilling fluid, for example in the case of bores which are greatly out of line, for which the spoil is mechanically removed from the bottom and put into suspension by rotation of the string.

A phenomenon of "pumping" of the spoil in certain cases, that is to say, the entrainment of spoil by displacement of the drill string towards the surface which then in practice plays the part of a piston.

Figure 4:
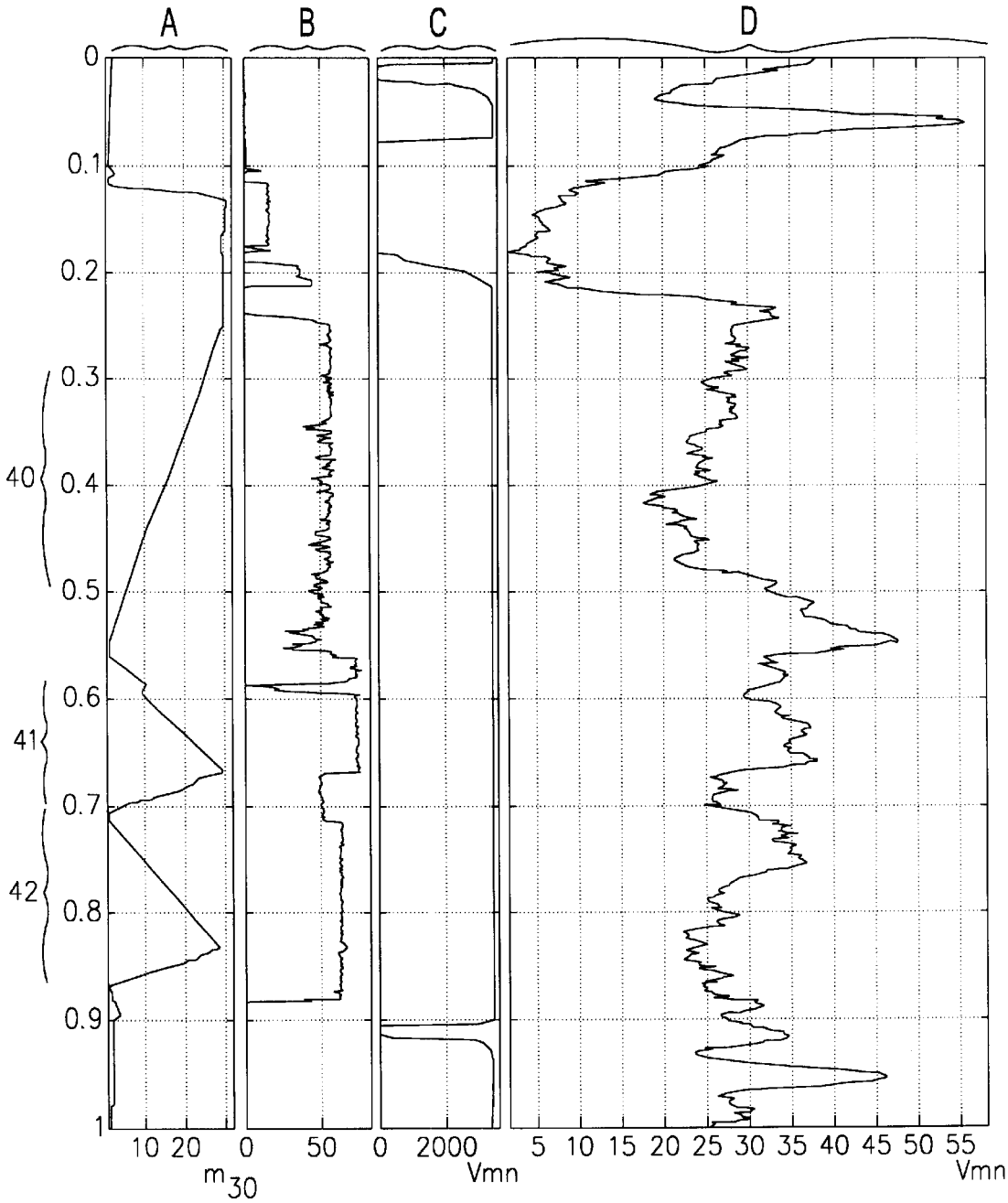
FIG. 4 shows an example of the continuous recording of the flow rate of the spoil correlated with a drilling operation.

FIG. 4 illustrates one of the records that the operator can obtain in the surface processing installation. Column represents the position of the hoisting block on the drilling tower, which represents the deepening of the drill. The scale on the x-axis is in meters (m) and in hours on the y-axis. The gradient of the peaks gives the rate of penetration of the bit (ROP). Column B represents the speed of rotation of the drill string in revolutions per minute. Column C gives the flow rate of the drilling fluid injected into the bore, in liters/minute. Column D represents the flow rate of the spoil during the drilling operation.

It will be noted that the spoil flow rate slowly reduces during the drilling phase with reference number 40, while both the forward and backward 41 and 42 movements of the string over about 30 meters allow a large quantity of spoil to be brought to the surface.

What is claimed is:

1. Device for measuring the flow rate of spoil from a drill and brought to the surface by a drilling fluid, said device comprising means for collecting the spoil, and means for continuous measurement of the weight of spoil collected, said means for collecting the spoil comprising a receptacle in the form of a bucket pivoting on a spindle, means for tilting said receptacle in such a way as to empty said bucket, and means for commanding said means for tilting, said means for commanding comprising a timer used to adjust the time during which said bucket is raised by the tilting means and during which the spoil is collected in said bucket, and said means for measurement comprising a measuring cell connected to said means for tilting in order to measure a stress substantially proportional to the weight of the spoil collected.

2. Device according to claim 1, wherein said means for tilting comprise a shaft rotating on two bearings, a pneumatic jack connected to said shaft, and a component connecting said jack with a fixed base.

3. Device according to claim 2, wherein said measuring cell is arranged on said connecting component.

4. Device according to claim 3, wherein said measuring cell measures a bending stress of said connecting component, the stress being substantially proportional to the weight of the spoil collected.

5. Device according to claim 1, wherein said means for tilting comprise pneumatic components with command logic for the sequence of operations for said means for tilting.

6. Method of measuring the flow rate of drilling spoil brought to the surface by a drilling fluid, wherein the following steps are carried out:

a) a period of time is adjusted and the spoil is collected continuously in a receptacle for said period of time, b) said spoil accumulated during said period is continuously weighed, c) said receptacle is emptied at the end of said period, d) operations a) and b) are repeated, e) the spoil weights are accumulated by measurement processing, f) calculation of the spoil flow rate is carried out, and g) the spoil flow rate measurement is processed in order to calculate and to record at least one of the following parameters: the flow rate of the spoil as a function of time, the ratio of the flow rate of the spoil to the rate of penetration, the ratio of the measured flow rate of the spoil to the theoretical flow rate of the drilled spoil, the difference between the measured flow rate of the spoil and the theoretical flow rate of the drilled spoil.

7. Method of measurement according to claim 6, wherein the mass flow rate is used to calculate said parameters.

8. Method according to claim 6, wherein the density of the collected spoil is measured.

9. Method according to claim 6, wherein the density of the dry spoil, that is to say the density of the spoil after removal of the drilling fluid, is measured.

10. Method according to claim 8, wherein the volume flow rate obtained using said density measurements is used to calculate said parameters.

* * * * *

UNITED STATES PATENT AND TRADEMARK OFFICE

CERTIFICATE OF CORRECTION

PATENT NO. : 6,410,862 B1
DATED : June 25, 2002
INVENTOR(S) : Lecann

It is certified that error appears in the above-identified patent and that said Letters Patent is hereby corrected as shown below:

Column 5,
Line 10, please insert the following omitted paragraph: -- The curve 34 is the result of the accumulation of the measured weights after several filling and emptying sequences. --

Signed and Sealed this

Tenth Day of December, 2002

JAMES E. ROGAN
*Director of the United States Patent and Trademark Office*